US009072326B2

(12) United States Patent
Becker et al.

(10) Patent No.: US 9,072,326 B2
(45) Date of Patent: Jul. 7, 2015

(54) PROTECTIVE GLOVE

(75) Inventors: Marielies Becker, Lueneburg (DE); Wolfgang Kesting, Bardowick (DE); Wolfgang Hornberger, Deutsch Evern (DE)

(73) Assignee: UVEX SAFETY GMBH & CO. KG, Lueneburg (DE)

( * ) Notice: Subject to any disclaimer, the term of this patent is extended or adjusted under 35 U.S.C. 154(b) by 177 days.

(21) Appl. No.: 13/816,831

(22) PCT Filed: Aug. 5, 2011

(86) PCT No.: PCT/EP2011/003935

§ 371 (c)(1),
(2), (4) Date: Feb. 13, 2013

(87) PCT Pub. No.: WO2012/019738

PCT Pub. Date: Feb. 16, 2012

(65) Prior Publication Data

US 2013/0139295 A1 Jun. 6, 2013

(30) Foreign Application Priority Data

Aug. 13, 2010 (DE) ..... 20 2010 011 380

(51) Int. Cl.
*A41D 19/00* (2006.01)
*A41D 19/015* (2006.01)
*D04B 1/28* (2006.01)

(52) U.S. Cl.
CPC ..... *A41D 19/015* (2013.01); *A41D 19/01505* (2013.01); *D04B 1/28* (2013.01)

(58) Field of Classification Search
CPC ..... A61B 19/04
USPC ..... 2/159, 163, 165, 167, 169, 161.1, 2/161.3, 161.7, 910
See application file for complete search history.

(56) References Cited

U.S. PATENT DOCUMENTS

| | | | | | |
|---|---|---|---|---|---|
| 612,741 | A | * | 10/1898 | Longden | 2/168 |
| 4,131,952 | A | * | 1/1979 | Brenning, Jr. | 2/16 |
| 4,863,084 | A | | 9/1989 | Nabozny | |
| 5,568,657 | A | * | 10/1996 | Cordova et al. | 2/167 |
| 6,155,084 | A | | 12/2000 | Andrews et al. | |

(Continued)

FOREIGN PATENT DOCUMENTS

| | | |
|---|---|---|
| CN | 201356084 | 12/2009 |
| DE | 10320628 | 11/2004 |
| DE | 102004010359 | 9/2005 |

(Continued)

OTHER PUBLICATIONS

International Search Report and Written Opinion dated Feb. 3, 2012 from corresponding PCT Application No. PCT/EP2011/003935, 9 pages.

*Primary Examiner* — Tejash Patel
(74) *Attorney, Agent, or Firm* — Stuart H. Mayer; Mayer & Williams PC

(57) ABSTRACT

The invention relates to a protective glove manufactured from at least two yarn components, wherein a first yarn component is processed continuously, and a second yarn component is left out in at least one region forming a predetermined tearing zone such that at least one predetermined tearing zone has a lower tearing resistance than the neighboring zones, wherein the predetermined tearing zone is provided at least partially with a coating.

20 Claims, 1 Drawing Sheet

(56) References Cited

U.S. PATENT DOCUMENTS

| | | | | |
|---|---|---|---|---|
| 6,962,064 | B1 | 11/2005 | Hardee et al. | |
| 7,908,891 | B2 * | 3/2011 | Thompson et al. | 66/174 |

FOREIGN PATENT DOCUMENTS

| | | |
|---|---|---|
| DE | 102007015961 | 10/2008 |
| WO | 00/32860 | 6/2000 |

* cited by examiner

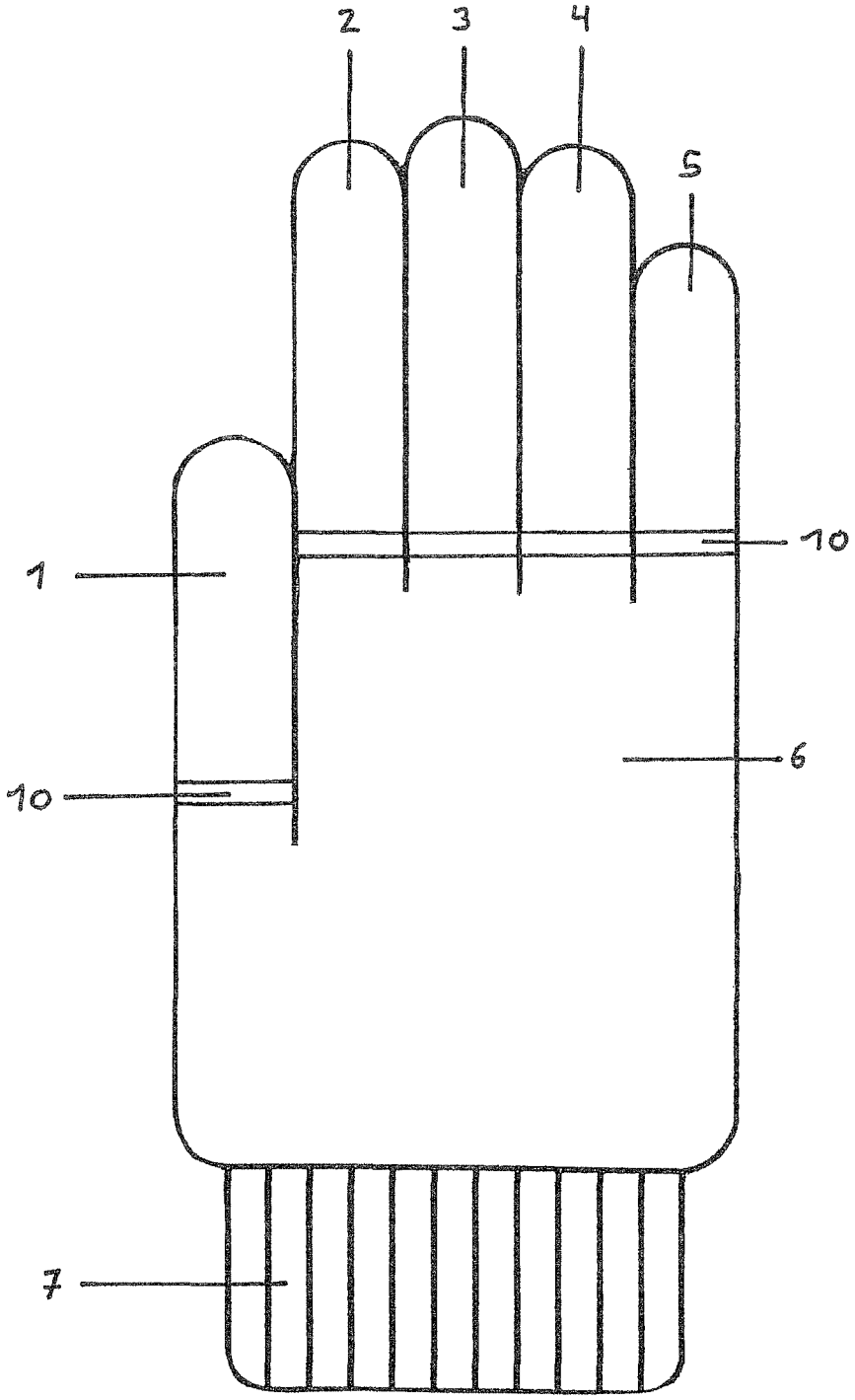
2
3
4
5
1
10
10
6
7

PROTECTIVE GLOVE

The invention relates to a protective glove.

When installing or processing sheet metal, sections and other metal components, the danger of hand injury exists. The mechanical stress on hands from using tools, gripping and holding sharp-edged or burr-containing workpieces, soiling and the related, often overly-aggressive skin cleaning are associated with the danger of injury and skin diseases. Wearing suitable protective gloves is consequently an important measure to minimize said risks of injury and avoid occupational skin diseases.

However, gloves cannot always be worn, especially with rotating tools such as cutters, drills or handheld screwdrivers since the danger exists of the gloves being grabbed and pulled in by the rotating device parts. A particular danger exists with hand-guided screwdrivers where the component to be screwed needs to be held manually during the screwing process. This can result in serious injury to fingers, hands or arms. Given these circumstances, protective gloves can substantially increase the risk of injury to the wearer, despite their protective effect. It is therefore impermissible to wear gloves when using numerous machines.

The prior art describes various textile fabrics and products in which tearing zones or predetermined breaking points are incorporated that are supposed to tear in a defined way under traction or pressure. For example in the automobile industry, textile materials are described with tearing zones that make it easier for an airbag to exit.

A knit seat cover is known from WO 00/32860 that tears in a defined way when an airbag exits. The defined tearing is achieved by knitting a thread with greater tear resistance and/or lower elasticity in a region of the knitted fabric that surrounds the stitch row to be torn in a defined way or the corresponding wales. For this purpose, an elasticity lower by more than 15% is selected. The selected tear resistance of the thread in this region is also approximately 0.05 to 0.25 of the tear resistance of the thread in the remaining knit fabric.

A textile covering for interior motor vehicle trim is known from DE 10 2004 010 359 A1 that has a defined airbag tear line. A thread weakened for this purpose is incorporated along the tear line in the knit or woven cover.

A textile fabric manufactured by forming stitches with an incorporated predetermined breaking point is known from DE 103 20 628 A1 where the predetermined breaking region is formed by at least one thread that connects the facing stitches of two neighboring regions of stitches. The thread possesses a reduced tear resistance and is knit at a width of 4 to 6 mm.

Suitable regions in glove products are also described that enable premature tearing under fraction.

A protective glove is known from CN 201 35 60 84 Y that consists of finger sections and a palm section. The finger sections and palm section are connected to each other by connecting parts, wherein the connecting parts are arranged along the perimeter of the joints between the finger parts and palm part. The known glove prevents the hand of a worker from being able to be caught in the machine, and the removed finger parts can be replaced independent of each other. Such gloves, however, need to be manufactured in a complex manner in the context of an assembly in which many prefabricated individual parts of the glove (finger sections, palm sections) are sewn and connected to each other. In contrast to gloves that are automatically knit without a seam (such as with Shima Seiki knitting machines), such a method has a complex manufacturing process. In addition, the existence of seams in the inside of the glove impairs wearing comfort.

A protective work glove with predetermined breaking points is known from DE 10 2007 015 961 A1. For this, the glove possesses perforations along the finger joints, and two intersecting perforations that run across the palm. The glove material that best fits the intended job can be selected. The precise manufacture, design and implementation of these perforations are not described. It is also not described whether these gloves are knitted without a seam, or are prefabricated, or respectively sewn.

A knitted glove is known from U.S. Pat. No. 6,962,064 B1, wherein the increased wearing comfort of densely knitted regions for the fingers and palms is provided.

A stack of disposable single-use gloves is known from U.S. Pat. No. 4,863,084 that are joinedly affixed to an attachment plate and can be torn off the attachment plate along a predetermined tear line in the region of the wrist.

A continuously knit protective glove is known from U.S. Pat. No. 6,155,084 that has a cut-protection-resistant fiber in a finger region, a fiber with greater cut protection in a hand and thumb region, and a cut protection fiber in a wrist region with protection that is greater than in the finger region and weaker than in the region of the palm and thumb.

The object of the invention is to provide a protective glove that reduces risk of injury even when using rotating tools.

This object is achieved according to the invention by the subject matter of claim 1. Advantageous embodiments can be found in the dependent claims, the description and the figures.

The object according to the invention is also achieved by a protective glove that is manufactured from at least two yarn components, wherein a first yarn component is processed in the region forming the pre-determined tearing zone of the glove, and a second yarn component is processed in the remaining region of the glove. The second yarn component has greater tear resistance than the first yarn component. The predetermined tear zone is provided at least partially with a coating. The first yarn component is preferably processed continuously.

The invention is based on the awareness that the predetermined breaking point must have very little elasticity such that tractive force is transmitted well to the predetermined breaking point and causes the desired tearing. Sufficiently quick tearing off cannot be achieved merely by the selected yarn components and their processing in the region of the predetermined tearing zone. Only when at least part of the predetermined tearing region is provided with a coating is the tearing-off force decreased sufficiently in the predetermined tearing zone to significantly reduce danger to the user. Coating the predetermined tearing zone ensures that the applied, low tractive force for tearing off a finger part of the glove in the direction of the fingers directly causes the finger part to tear off with little stretching. A coating significantly reduces the maximum tensile elongation in the predetermined breaking region by 20%-40% in comparison to an uncoated predetermined breaking region.

The protective glove according to the invention accordingly has at least partially coated zones that possess less tearing resistance than the neighboring zones. If greater force is exerted on the glove for example because the glove is caught in a tool with rotating parts, the glove tears into at least two parts at said predetermined tearing zones. One part or parts of the glove are then torn from the hand of the wearer while the remaining part remains in its position. Accordingly, the hand of the wearer is not dragged into the tool and remains free of injury. In this manner, the risk of injury is reduced for the wearer of the glove according to the invention when using tools with rotating components. However, there is at the same time no reduction in the protective effect of the glove. The protective glove according to the invention can have the same properties as known protective gloves. The dimensions of the predetermined tearing zone can be selected to minimize any potential sacrifice of the protective effect in the region of the predetermined tearing zone.

The glove is preferably knit seamlessly from at least two yarn components. Knitting the glove from two or more yarn components makes it possible to adjust the tearing force in the predetermined tearing zone by means of the yarn selection, stitch height and other technical knitting parameters to yield, together with the coating, the desired low tearing-off force coupled with reduced elasticity. Protective gloves can be automatically knit seamlessly and completely on modern glove knitting machines (such as the Shima Seiki). Due to the lack of seams, such products have significant ergonomic wearing comfort. This technology in the production of seamless knit gloves enables an economical and productive manufacturing process. By using and altering the machine parameters, different glove features can be specifically changed (geometry, stitch density, stitch height). Furthermore, such knitting machines are equipped with additional functions (a color changing device, plating device) that enable a broader use.

The protective glove can be knit completely without seams on a glove knitting machine with an electronically controlled plating device. The two yarn components can simultaneously enter the knitting machine and be knitted simultaneously by means of a single yarn guide in each case. During knitting, the feeding of one yarn component can be automatically stopped. For this purpose a plating yarn guide of a knitting machine can be stopped in an electronically controlled manner. Then, only the other yarn component is knit in the region of the predetermined tearing zone. After a few stitch rows, both components are again knit. The number of stitch rows that are only knit with a single yarn component determines the width of the predetermined tearing zone. Individual stitch rows can be left out for this purpose.

Alternatively to the plated knitting zones, the glove knitting machine can also be equipped with a color changing device that makes it possible to alternately knit two yarns seamlessly. When using a color changing device, only one yarn component is always knit in the protective glove. In the predetermined tearing zone, the yarn component is knit with reduced tearing resistance, whereas the yarn component with the greater tearing resistance is knit outside of the predetermined tearing zone.

In one embodiment of the invention, one yarn component can have a tensile strength that differs from another yarn component. Accordingly, the yarn component that is knit by itself in the region of the predetermined tearing zone has less tensile strength so that the glove tears faster, i.e., under less force, when correspondingly high tensile force arises in the predetermined tearing zone.

The employed yarn components can have different yarn fineness. Different fibers and yarn materials can also be provided. One or more yarn components can also be yarn constructs, such as core-spun yarns, hybrid yarns, and yarn mixtures.

In a preferred embodiment, the yarn component with the lower tear resistance has a strength of 10 to 40 Denier, preferably 15 to 25 Denier, and particularly preferably 20 Denier. With a coating, this strength makes it possible to achieve a tear resistance of 20 to 60 N, and preferably 40 N. This supports in particular the desired tearing resistance of 20 to 60 N for tearing off a finger when using what is technically termed a partially oriented yarn (POY). The employed partially oriented yarn preferably consists of polypropylene, polyester and/or polyamide, wherein elastane can be added and/or processed with the yarn. POY yarns are manufactured using a melt spinning process by adjusting the withdrawal speed to achieve a partial orientation of the plastic.

The tearing force in the predetermined breaking zone is determined using a tensile test machine with reference to the standard EN 388 (measurement of tear resistance) by means of which the mechanical properties of protective gloves can be tested. The index finger is clamped in a top clamp, and the entire palm of the glove is clamped in a bottom clamp of the tensile test machine. The tearing force is measured which is necessary to tear off the index finger. With conventional gloves (for example 4×70 Denier polyamide) without a predetermined tearing zone, a tearing force of 200 to 900 N is necessary for the index finger. If a predetermined tearing zone coated according to the invention is incorporated in the index finger, the tearing force is preferably less than 60 N.

In a preferred embodiment of the invention, at least one predetermined tearing zone runs along the perimeter of a finger of the protective glove. The predetermined tearing zone can also run across the palm substantially horizontal to the vertical longitudinal axis of the fingers. The predetermined tearing zone preferably runs close to the proximal end of a finger. The predetermined tearing zone can run at the position in which a ring is normally worn. A plurality of fingers, or all fingers as well as the thumb of the protective glove can have a predetermined tearing zone. The predetermined tearing zone is preferably aligned at a right angle to the longitudinal axis of the finger. In addition, any number of predetermined tearing zones can be knit into the protective glove. Periodic arrangements of a plurality of predetermined tearing zones are also conceivable.

The glove can also be manufactured from other textile materials such as fleece, warp-knitted fabrics or woven goods. The glove is preferably knit with two yarn components.

In one possible embodiment, the protective glove and the predetermined tearing zone can be at least partially coated within an elastomer. Elastomer coatings can be used as possible coating materials such as for example: Nitrile, chloroprene, polyurethane, latex or polyvinyl chloride.

An exemplary embodiment of the invention is explained in greater detail below with reference to a FIGURE.

FIG. 1 schematically portrays a protective glove according to the invention that is completely knit on a special glove knitting machine. The protective glove has a thumb 1 and four additional fingers 2, 3, 4, 5 as well as a palm 6 and a wrist 7. The parts of the glove are named after the parts of a hand that are covered by the glove.

A predetermined tearing zone 10 is provided close to the proximal end of the fingers 1, 2, 3, 4, 5, that is, close to the transition to the palm 6. This runs in an annular manner around the perimeter of the fingers 1, 2, 3, 4, 5 of the protective glove and connects them to the palm 6. The predetermined tearing zone 10 has a lower tearing resistance than the other parts of the glove. If the glove is caught in a rotating machine, for example on the head of a drill, and significant tractive force is exerted on a finger 1, 2, 3, 4, 5 of the glove, the finger of the glove 1, 2, 3, 4, 5 is torn from the palm 6 at the predetermined tearing zone 10. Then only the torn-off finger 1, 2, 3, 4, 5 of the glove becomes entangled in the machine. The remaining glove and in particular the corresponding finger of the individual wearing the glove can remain undamaged.

The protective glove is knit from two yarn components, wherein one of the two yarn components is left out in the region of the predetermined tearing zone 10. Consequently, the predetermined tearing zone 10 comprises only one yarn component and accordingly also has a lower tearing resistance than the remaining parts of the glove. The tearing resistance and elasticity of the predetermined tearing zone 10 can be influenced by several factors such as the material used or the stitch width; however, the low elasticity desired for practical use can only be achieved by means of an additional coating. The tearing-off force of a finger 1, 2, 3, 4, 5 with the predetermined tearing zone 10 is 20 to 60 N. In comparison, conventional gloves have a tearing-off force of 200 to 900 N.

Experiments have revealed that especially when rotating tools are used such as hand-held screwdrivers, the coating of the glove also prevents the tool from being caught in the textile; consequently, the coating additionally prevents the hazard of being caught.

The partially coated predetermined tearing zones are preferably coated on the inside of the hand over an angular range of 90° to 270°, and preferably 180°. The side of the predetermined tearing zone facing the back of the hand is not coated which, overall, yields the desired tearing-off force. Completely coated predetermined tearing zones with an angular range of up to 360° are, however, also possible. The desired tearing-off force can be precisely adjusted by means of the angular range in which the knit predetermined tearing zone is coated. The tearing-off force initially increases as the coating increases along the perimeter of the predetermined tearing zone in order to achieve a maximum value when the predetermined tearing zone is almost completely coated.

The following provides a few examples of the structure of a protective glove according to the invention that is knit from two yarn components (component A and B):

1) Equivalent Fiber and Yarn Materials and Different Yarn Fineness:
   - Component A: Polyamide 1×40 Denier, POY
   - Component B: Polyamide 1×200 Denier
2) Different Fiber and Yarn Materials
   - Component A: Cellulose, viscose, cotton, elastane (low tearing force)
   - Component B: Polyester, polyamide, aramide (Kevlar), high-performance polyethylene (HPPE), elastane
3) Different Fiber and Yarn Constructs
   - Component A: Cellulose, viscose, cotton (low tearing force), elastane
   - Component B: Core-spun yarns:
     - Core: Glass, inox, HPPE, elastane
     - Sheath: Polyamide, aramide, cellulose, bamboo and/or
     - Yarn and fiber mixtures:
     - Polyester/cotton 50%/50%, elastane twined yarns.

The invention claimed is:

1. A protective glove, comprising at least two yarn components, wherein a first yarn component is processed continuously in a region forming a pre-determined tearing zone of the glove, wherein a second yarn component is processed in a remaining region of the glove and has a greater tear resistance than the first yarn component, the predetermined tearing zone being at least partially coated.

2. The protective glove according to claim 1, wherein the two yarn components are processed together, and only the first yarn component with the lower tearing resistance is processed in the predetermined tearing zone.

3. The protective glove according to claim 1, wherein the at least two yarn components are knit seamlessly.

4. The protective glove according to claim 1, wherein the first yarn component has a tensile strength and/or elasticity that differs from the second yarn component.

5. The protective glove according to claim 1, wherein the first yarn component has a yarn strength that differs from the second yarn component.

6. The protective glove according to claim 1, wherein the first yarn component and the second yarn component are formed from different fiber materials.

7. The protective glove according to claim 1, wherein the first yarn component and the second yarn component are formed with different yarn constructs.

8. The protective glove according to claim 1, wherein the predetermined tearing zone runs along the perimeter of one finger.

9. The protective glove according to claim 1, wherein each finger of the protective glove has a predetermined tearing zone.

10. The protective glove according to claim 1, wherein the predetermined tearing zone comprises two to five stitch rows.

11. The protective glove according claim 1, wherein the predetermined tearing zone is at least partially coated with an elastomer coating.

12. The protective glove according to claim 11, wherein the elastomer coating comprises nitrile, chloroprene, polyurethane, latex or polyvinyl chloride.

13. The protective glove according to claim 1, wherein the first yarn component with the lower tearing resistance has a strength of 15 to 25 Denier.

14. The protective glove according to claim 1, wherein the first yarn component with the lower tearing resistance is a partially oriented yarn.

15. A protective glove, comprising at least two yarn components, wherein a first yarn component is processed in a region forming a pre-determined tearing zone of the glove, wherein a second yarn component is processed in a remaining region of the glove and has a greater tear resistance than the first yarn component, the predetermined tearing zone being at least partially coated, wherein the predetermined tearing zone comprises two to five stitch rows.

16. A protective glove, comprising at least two yarn components, wherein a first yarn component is processed in a region forming a pre-determined tearing zone of the glove, wherein a second yarn component is processed in a remaining region of the glove and has a greater tear resistance than the first yarn component, the predetermined tearing zone being at least partially coated, wherein the first yarn component with the lower tearing resistance has a strength of 15 to 25 Denier.

17. The protective glove according to claim 15, wherein the two yarn components are processed together, and only the first yarn component with the lower tearing resistance is processed in the predetermined tearing zone.

18. The protective glove according to claim 15, wherein the at least two yarn components are knit seamlessly.

19. The protective glove according to claim 16, wherein the two yarn components are processed together, and only the first yarn component with the lower tearing resistance is processed in the predetermined tearing zone.

20. The protective glove according to claim 16, wherein the at least two yarn components are knit seamlessly.

* * * * *